US009596961B2

(12) United States Patent
Stokely et al.

(10) Patent No.: US 9,596,961 B2
(45) Date of Patent: Mar. 21, 2017

(54) USE OF RIGID POLYURETHANE FOAM TO ENCAPSULATE PLUMBING IN A THERAPY BATH

(75) Inventors: Andrew Warren Stokely, Hendersonville, TN (US); Michael Glenn Geels, Jackson, TN (US)

(73) Assignee: Delta Faucet Company, Indianapolis, IN (US)

( * ) Notice: Subject to any disclaimer, the term of this patent is extended or adjusted under 35 U.S.C. 154(b) by 210 days.

(21) Appl. No.: 13/883,810

(22) PCT Filed: Sep. 2, 2011

(86) PCT No.: PCT/US2011/050376

§ 371 (c)(1),
(2), (4) Date: May 7, 2013

(87) PCT Pub. No.: WO2012/067701

PCT Pub. Date: May 24, 2012

(65) Prior Publication Data

US 2013/0227778 A1 Sep. 5, 2013

Related U.S. Application Data

(60) Provisional application No. 61/413,575, filed on Nov. 15, 2010.

(51) Int. Cl.

| | |
|---|---|
| ***A47K 3/02*** | (2006.01) |
| ***A47K 3/04*** | (2006.01) |
| ***A47K 3/30*** | (2006.01) |
| ***B05D 3/12*** | (2006.01) |
| ***A47K 3/16*** | (2006.01) |

(52) U.S. Cl.

CPC ..... *A47K 3/04* (2013.01); *A47K 3/02* (2013.01); *A47K 3/16* (2013.01); *A47K 3/30* (2013.01); *B05D 3/12* (2013.01); *Y10T 29/49* (2015.01); *Y10T 29/49826* (2015.01)

(58) Field of Classification Search

CPC ..... A61H 33/6005; A61H 33/6063; A61H 33/6021

USPC ..... 4/541.1, 541.3, 541.4, 541.5, 584

See application file for complete search history.

(56) References Cited

U.S. PATENT DOCUMENTS

| | | | | |
|---|---|---|---|---|
| 3,816,234 | A * | 6/1974 | Winfield | 428/317.9 |
| 4,000,528 | A * | 1/1977 | Posnick | 4/584 |
| 4,010,498 | A * | 3/1977 | Jablonski | 4/569 |
| 4,166,296 | A * | 9/1979 | Darrah et al. | 4/488 |
| 4,804,210 | A | 2/1989 | Hancock | |
| 4,811,434 | A * | 3/1989 | Satterfield | 4/541.5 |

(Continued)

FOREIGN PATENT DOCUMENTS

| | | | | |
|---|---|---|---|---|
| DE | EP224615 A2 * | 6/1987 | ..... | A61H 33/02 |

OTHER PUBLICATIONS

International Search Report prepared for PCT Application PCT/US11/50376 completed Feb. 8, 2012.

*Primary Examiner* — Erin Deery

(74) *Attorney, Agent, or Firm* — Carlson, Gaskey & Olds, PC

(57) ABSTRACT

A wall structure for a composite tub includes a surface side for facing an interior of the tub, a polyurethane layer backing and attaching to the surface side, plumbing backing the polyurethane layer, and an encapsulation layer encapsulating the plumbing and backing and attaching to the polyurethane layer so that damage to the plumbing is minimized.

7 Claims, 1 Drawing Sheet

(56) References Cited

U.S. PATENT DOCUMENTS

| | | | | | |
|---|---|---|---|---|---|
| 5,164,093 | A | * | 11/1992 | Chilton | B01D 53/02 134/902 |
| 5,215,796 | A | * | 6/1993 | Mueller | B29C 44/0461 264/46.4 |
| 5,345,621 | A | * | 9/1994 | Livingston | 4/541.1 |
| 5,527,412 | A | * | 6/1996 | Hansen et al. | 156/215 |
| 5,543,225 | A | * | 8/1996 | Mueller | B32B 5/32 428/218 |
| 5,799,345 | A | * | 9/1998 | Hansen et al. | 4/584 |
| 5,940,904 | A | | 8/1999 | Lutz | |
| 2005/0166311 | A1 | * | 8/2005 | Yandell | 4/541.1 |
| 2006/0137087 | A1 | * | 6/2006 | Carreau et al. | 4/541.1 |

* cited by examiner

USE OF RIGID POLYURETHANE FOAM TO ENCAPSULATE PLUMBING IN A THERAPY BATH

RELATED APPLICATION

This application is a United States National Phase of PCT Application No. PCT/US11/50376 filed on Sep. 2, 2011, which claims priority to U.S. Provisional Application No. 61/413,575 filed on Nov. 15, 2010.

TECHNICAL FIELD

This disclosure relates to composite bathing vessels.

BACKGROUND

Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the requirements is approved for use in homes, buildings or other structures as a plumbing fixture.

Therapy bathing vessels commonly referred to as air tubs and whirlpools, use piping through with the air and/or water is moved to provide a massaging experience for which they are known. Therapy tubs are typically manufactured using a thermoformed surface layer backed with thermoset polyester that is reinforced with fiber glass. This method of construction has been in practice for many years. The bathing vessel is manufactured and holes are then drilled in locations into the piping for the water to feed the pump and the water and/or air to enter the bath.

The water and/or air is moved through external piping that is connected from the pipe or blower to the holes in the bathing vessel. A more recent method utilizes channels that are incorporated into the structure of the bathing vessel and are encapsulated within the polyester reinforcing composite material.

SUMMARY

According to an embodiment disclosed herein, a wall structure for a composite tub includes a surface side for facing an interior of the tub, a polyurethane layer backing and attaching to the surface side, plumbing backing the polyurethane layer, and an encapsulation layer encapsulating the plumbing and backing and attaching to the polyurethane layer so that that damage to the plumbing is minimized.

According to a further embodiment disclosed herein, a wall structure for a composite tub includes a surface side for facing an interior of the tub, a polyurethane layer backing and attaching to the surface side, a cap layer encapsulating the polyurethane layer, and plumbing backing the cap layer such that damage to the plumbing is minimized.

These and other features of the present invention can be best understood from the following specification and drawings, the following of which is a brief description.

DETAILED DESCRIPTION

Figure 1:
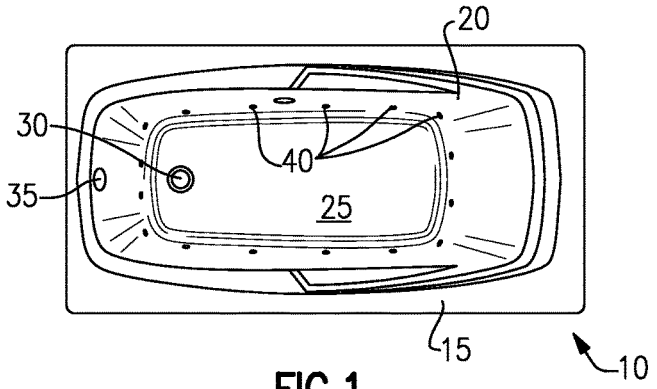
FIG. 1 is a top view of a therapy tub incorporating an embodiment of the invention.

FIG. 1 shows a tub incorporating several embodiments as mentioned. The tub 10 has a ledge 15, side walls 20, a bottom 25, drain 30, an overflow 35, and air or water openings 40 through which air or water is distributed to give a user a therapeutic experience.

Figure 2:
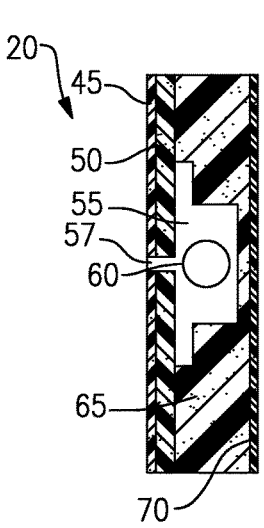
FIG. 2 is a side view of a first embodiment of a construction of a side wall of a tub of FIG. 1.

Referring now to FIG. 2, a first embodiment of construction of the side wall 20 is shown. The side wall 20 is constructed of several layers starting with a surface side 45 which forms the interior of the bathing vessel, an initial layer relatively thin layer of polyurethane foam 50, an air or water jet housing assembly 55 which connects conventionally to the water or air opening 40 shown in FIG. 1 through opening 57, a relatively thick (relative to said initial layer 50) encapsulation layer 65 of rigid polyurethane foam, and a cap layer 70 of rigid polyurethane foam or an elastomer.

The surface side 45 of the tub 10 is a thermoformable plastic such as polymethyl methacrylate (PMMA) that is backed with acrylonitrile butadiene styrene (ABS). The plastic is formed into the shape of a bathing vessel by using standard vacuum forming techniques. The initial rigid polyurethane foam 50 supplied to the back side of the surface side 45 provides structural rigidity and may be closed cell. Standard plumbing is installed in or against the thin layer of rigid polyurethane, which includes the piping 60 and the jet housing assembly 55 among other things such as bushings, fittings, connectors, filters, gaskets, etc.

After the plumbing 55, 60 is installed, the encapsulation layer of rigid polyurethane foam 65 is supplied to encapsulate the plumping. The final layer 70 of high density polyurethane foam or elastomer is then applied, though it is not always required.

Figure 3:
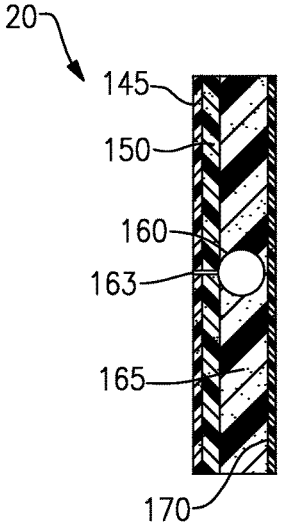
FIG. 3 is a side view of a second embodiment of a construction of a side wall of a tub of FIG. 1.

Referring now to FIG. 3, a second embodiment is described herein. This embodiment has an initial layer surface side 145, an initial layer of polyurethane foam 150 attached thereto, air piping or a channel 160 is then applied to the back of the polyurethane foam 150, a hole 163 is drilled to allow communication with the air piping or channel 160, and the installation is then encapsulated with rigid polyurethane foam 165. The entire assembly is then capped with a layer 170 of rigid polyurethane foam or an elastomer though it is not always required. In this embodiment, the channel 160 may be pushed into the initial layer of polyurethane foam 150 before the initial layer of polyurethane foam 150 cures.

Figure 4:
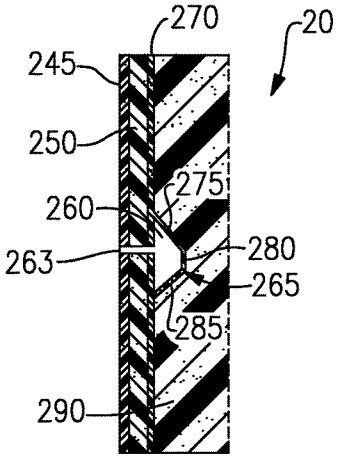
FIG. 4 is a side view of a third embodiment of a construction of a side wall of the tub of FIG. 1.

Referring now to FIG. 4, another embodiment of the invention is disclosed. The embodiment has surface side 245, an initial layer of rigid foam 250 attaching to the surface side 245, a hole 263 for air to enter the bathing vessel from a channel 260 that is made of a layer 265 of rigid polyurethane foam and a cap layer 270 of rigid polyurethane foam or elastomer may be placed over the entire assembly of rigid polyurethane foam 250 though it is not always required.

The air piping or channel 260 has three legs. A first leg 275 angles away from the cap layer 270 and a back leg 280 attaches to a second leg 285, which also attaches to the cap layer and also angles away from the cap layer 270. The legs 275, 280, 285 are also made of a rigid polyurethane foam.

Because the legs 275, 280, 285 are made of the same material as the cap layer 270 when constructing the channel 260 or attaching it to the cap layer 270, a chemical bond is obtained that is both strong and not prone to leak. The channel 260 may then be covered with another layer of elastomeric foam 290. In this embodiment, the channel 260 may be pushed into the cap layer 270 before the cap layer 270 cures to obtain a chemical bond therebetween.

Issues with external piping are related to their exposure during packaging, transportation and installation that may cause them to come loose or otherwise be damaged, resulting in leaks. Heretofore, it has not been feasible to encapsulate plumping piping within the composite structure of the therapy bathing vessel due to the amount of material required and the nature of the application of this material. This disclosure allows for the use of fixed plumbing, to minimize residual water entrapment and encapsulate the plumbing within the composite structure to minimize the risk of damage.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A wall structure for a composite tub, said structure comprising:

at least one side wall extending upwardly from a bottom surface of the composite tub, wherein the at least one side wall comprises at least a surface layer that faces an interior of the composite tub;

a structural layer having a first side attached to the surface layer and a second side opposite the first side, and wherein said structural layer comprises a rigid polyurethane foam;

plumbing directly attached to the structural layer; and a third layer that encapsulates the plumbing, and wherein the plumbing and the third layer are comprised of a rigid polyurethane foam, and wherein the plumbing comprises a channel positioned between the structural layer and the third layer, and wherein the channel is comprised of a pair of legs attaching to and extending from said structural layer and a third leg attached to each leg of said pair of legs to form the channel.

2. The wall structure of claim 1 further comprising:

a plurality of openings formed in the at least one side wall, and wherein each opening extends through the surface layer and the structural layer to fluidly connect to the plumbing, and wherein the plumbing has a first side that faces the opening and a second side facing opposite the first side, and wherein an entire surface of the second side is directly engaged by the third layer.

3. The wall structure of claim 1 wherein an opening passes through the surface layer, the structural layer and the plumbing.

4. A wall structure for a composite tub, said structure comprising:

a surface layer that faces an interior of the composite tub;

a structural layer having a first side attached to the surface layer and a second side opposite the first side, and wherein said structural layer comprises a rigid polyurethane foam; and a third layer including plumbing, wherein the third layer is attached directly to the second side of the structural layer, and wherein the third layer comprises a rigid polyurethane foam or elastomer, and wherein the plumbing and the third layer are comprised of the same material, and wherein the plumbing comprises a channel formed as part of the third layer and which is comprised of a pair of legs attaching to and extending from the third layer.

5. The wall structure of claim 4 wherein the channel further comprises a third leg attaching to each leg of the pair of legs.

6. A wall structure for a composite tub, said structure comprising:

a first layer having an external surface that faces an interior of the composite tub;

a second layer having a first side directly attached to the first layer and a second side opposite the first side, the second layer comprising a rigid polyurethane foam;

a third layer directly attached to the second side of the second layer, the third layer comprising a rigid polyurethane foam or elastomer;

plumbing attached to the third layer;

an opening extending from the external surface of the first layer to the plumbing; and a fourth layer directly attached to the third layer and surrounding the plumbing, the fourth layer comprising a foam material.

7. The wall structure of claim 6 wherein the plumbing has a first side directly engaging the third layer and a second side that faces opposite the first side, and wherein an entire surface of the second side is directly engaged by the fourth layer.

* * * * *